US009148721B2

(12) United States Patent
Cedro

(10) Patent No.: US 9,148,721 B2
(45) Date of Patent: Sep. 29, 2015

(54) SYSTEM, METHOD AND APPARATUS FOR SILENT TRUE BYPASS SWITCHING

(71) Applicant: Robert Cedro, Fairfield, CA (US)

(72) Inventor: Robert Cedro, Fairfield, CA (US)

(73) Assignee: DUNLOP MANUFACTURING, INC., Benicia, CA (US)

( * ) Notice: Subject to any disclaimer, the term of this patent is extended or adjusted under 35 U.S.C. 154(b) by 337 days.

(21) Appl. No.: 13/830,228

(22) Filed: Mar. 14, 2013

(65) Prior Publication Data

US 2014/0270267 A1 Sep. 18, 2014

(51) Int. Cl.
*H04R 3/00* (2006.01)
*H04R 27/00* (2006.01)

(52) U.S. Cl.
CPC *H04R 3/00* (2013.01); *H04R 27/00* (2013.01); *H04R 2227/003* (2013.01); *H04R 2420/01* (2013.01); *H04R 2420/07* (2013.01)

(58) Field of Classification Search
None
See application file for complete search history.

(56) References Cited

U.S. PATENT DOCUMENTS 4,479,238 A * 10/1984 Spector ..... 381/61
2005/0195991 A1* 9/2005 Wang et al. ..... 381/94.5

* cited by examiner

*Primary Examiner* — Brenda Bernardi
(74) *Attorney, Agent, or Firm* — Stuart J. West; Shaun N. Sluman; West & Associates, A PC

(57) ABSTRACT

A system, method and apparatus in the field of signal processing with particular applications to the specialized field of audio signal processing as it is used in the production or performance of music that is adapted and/or configured to mitigate or attenuate unwanted signals during a switching process between an effects apparatus and a signal bypass.

11 Claims, 12 Drawing Sheets

SYSTEM, METHOD AND APPARATUS FOR SILENT TRUE BYPASS SWITCHING

BACKGROUND

1. Field of the Invention

The present disclosure relates generally to signal switching systems, methods and apparatuses and more specifically to a signal switching systems, methods, and apparatuses for mitigating unwanted signals.

2. Background

The present disclosure generally relates to the field of signal processing with particular applications to the specialized field of audio signal processing as it is used in the production of music. Specifically, this disclosure relates to a class of component devices comprising a signal processing system for use by practitioners of the field of signal processing.

In many applications for signal processing, there can be two classes of signals; desired signals and unwanted signals. In these applications, the objective is often to separate these two classes of signals towards the ultimate goal of isolating and recovering the desired signals. In some signal processing applications, a plurality of signal processing devices can be configured into the signal path of the signal processing system. The act of enabling or disabling these signal processing devices during the production of a signal will often introduce unwanted signals known as switching transients. Switching transients are one sub-class of unwanted signal that can result from the signal processing activity, itself. Avoiding the introduction of these switching transients is often desirable.

This issue is particularly acute in the creation of audio signals in the production music. Musicians, artists, producers, technicians and others often use signal processing devices to alter the audio signals as they are created. These signal processing devices comprise amplifiers, synthesizers, digital effects generators, dynamic effects, filter effects, modulation effects, distortion effects, pitch/frequency effects, time based effects, feed back/sustain effects, etc. Creators of audio signals often cascade a finite number of signal processing devices together in series and/or parallel combinations and then activate these devices individually or in combination to create a desired sound.

While creating such desired sounds, these signal processing devices can be engaged and disengaged in arbitrary combinations at random times. The action of engaging and disengaging these signal processing devices can result in undesirable sounds known as switching transients that manifest as pops, static bursts, squeals, clicks, thumps, etc. These switching transients are not wanted, can ruin the desired effect, and are very difficult to remove once they are introduced into the audio signal.

What is needed is a "silent" true bypass system, apparatus and method, adapted and configured to minimize, reduce and/or suppress transient signals in the output resulting from switching from a first signal path to a second signal path.

DETAILED DESCRIPTION

Figure 1:
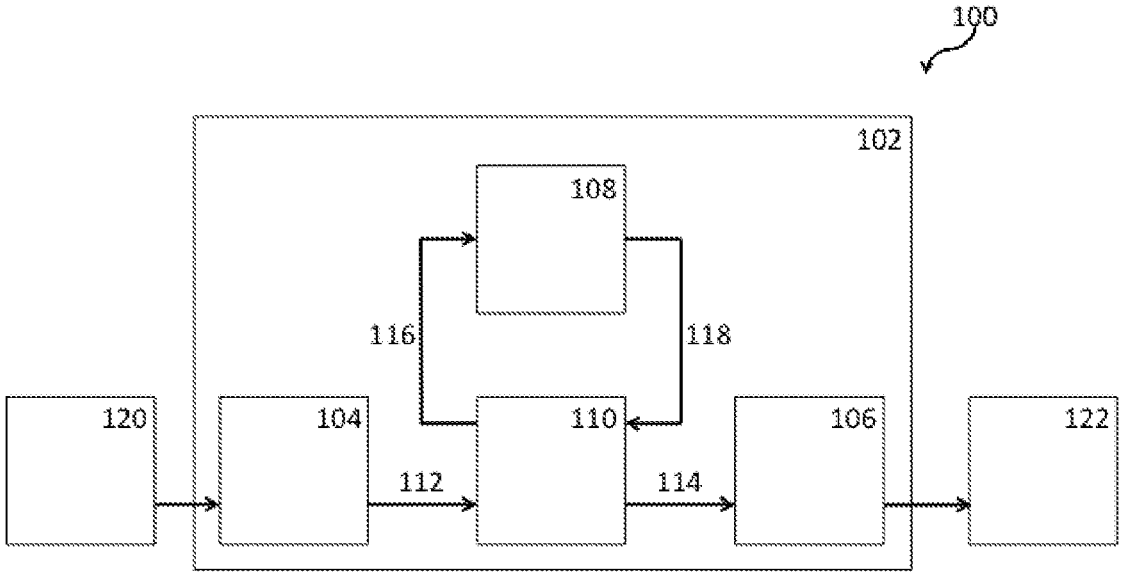
FIG. 1 depicts a high-level overview diagram of one embodiment of a signal processing device comprising a bypass switching system.

FIG. 1 depicts an overview diagram of an embodiment of a signal processing system 100 comprising a bypass switching system 110. As depicted in the embodiment shown in FIG. 1, some embodiments of a signal processing device 102 can comprise a bypass switching system 110, an input interconnect unit 104, an output interconnect unit 106, and a signal effects unit, 108. Components of signal processing devices 102 can have a physical realization, a virtual realization or a combination of both physical and virtual realizations. In some embodiments, a virtual realization can be implemented as software wherein an application can be embedded in a component of the device 100 or run on an alternate device. In alternate embodiments, a software application can be remotely hosted on processing system and/or any other known and/or convenient processor capable of or adapted to execute software. In some embodiments, components of a signal processing device 100 can reside within the boarders of the device 100. In alternate embodiments of device 100, some of the components can be remotely located and/or may be absent.

A signal processing device 102 can couple with a signal source 120. In alternate embodiments, device 102 may couple with a plurality of signal sources 120. A signal source 120 can be a device that delivers signals to a signal processing device 102, and/or any other known and/or convenient device capable or adapted to delivering signals. In alternate embodiments, a signal source 120 can comprise one or more signal originators. Signal originators can be devices that create signals for delivery by a signal source 120. In alternate embodiments, signal originators can be signal generators, signal transducers, and/or any other known and/or convenient device capable of or adapted to quantifying a physical characteristic and/or encoding information in the form of a signal for delivery by a signal source. In audio signal processing embodiments, signal originators can be any class or type of musical instrument(s) and/or any other known and/or convenient device capable of or adapted to generating and/or converting sound to the form of a signal for delivery by a signal source. In alternate audio signal processing embodiments, signal originators can be a class of stringed instruments. In some embodiments, a signal originator can be a guitar.

A signal processing device 102 can couple with a signal receiver 122. A signal receiver can be a device that accepts a signal from a signal processing device 102, and/or any other known and/or convenient device capable, adapted or configured to deliver a signal. In some embodiments, signal receivers 122 can be other signal processing devices 102. In alternate embodiments a signal receiver 122 can be a signal recoding device and/or any other known and/or convenient device capable of accepting, capturing, recording, and/or archiving signals. In some audio signal processing embodiments, a signal receiver 122 can include an audio recording system and/or sound reinforcing system.

In some embodiments, a signal processing device 102 can function as a signal source 120; coupling with and delivering signals to other signal processing devices 102. In alternate embodiments, a signal processing device 102 can function as a signal receiver 122; coupling with and accepting signals from other signal processing devices 102. In further embodiments, a signal processing device 102 can function as both a signal source 120 and a signal receiver 122 coupling with another signal source 120 and a signal receiver 122. In yet other embodiments, a signal processing device 102 can couple with a plurality of signal sources 120 and/or a plurality of signal outputs 122.

As shown in FIG. 1, an input interconnect unit 104 can facilitate a coupling between a device 102 and a signal source 120, or a plurality of signal sources. In some embodiments, an input interconnector 104 can comprise a mechanism for mechanically coupling with source 120, and/or a mechanism for electromagnetically coupling with source 120 and/or a mechanism for protecting other components of the signal processing device 102 from damaging signals and/or any other known and/or convenient device capable of coupling two devices for purposes of receiving a signal.

In some embodiments a mechanism for mechanical coupling can be an audio jack. In alternate embodiments a mechanism for mechanical coupling can be an electro-optical connector. In yet further alternate embodiments mechanisms for mechanical coupling can be a ¼" audio jack, a ⅛" audio jack, an RCA jack, an XLR jack and/or any other known and/or convenient connector capable of or adapted to forming a mechanical connection.

Also shown in FIG. 1, an input interconnect unit 104 can facilitate a coupling between a device 102 and a signal receiver 122, or a plurality of signal sources. In some embodiments, an output interconnector 106 can comprise a mechanism for mechanically coupling with receiver 122, and/or a mechanism for electromagnetically coupling with receiver 122 and/or a mechanism for protecting other components of the signal processing device 102 from damaging signals and/or any other known and/or convenient device capable of coupling two devices for purposes of delivering a signal.

In some embodiments a mechanism for mechanical coupling can be an audio jack. In alternate embodiments a mechanism for mechanical coupling can be an electro-optical connector. In yet further alternate embodiments mechanisms for mechanical coupling can be a ¼" audio jack, a ⅛" audio jack, an RCA jack, an XLR jack and/or any other known and/or convenient connector capable of or adapted to forming a mechanical connection.

The signal effects unit 108, depicted in FIG. 1, can comprise a mechanism for modifying a signal. In one embodiment, the signal effects unit can be a filter, an amplifier, a noise canceller and/or any other known and /or convenient processor capable of or adapted to perform operations on, analysis of and measurements on signals. In an audio signal processing embodiment, the signal effects unit can comprise amplifiers, synthesizers, digital effects generators, dynamic effects, filter effects, modulation effects, distortion effects, pitch/frequency effects, time based effects, and/or feed back/sustain effects and/or any other known and/or convenient device capable of or adapted to modifying signals.

The signal processing device 102 can further comprise a plurality of signal paths. In the embodiment depicted in FIG. 1, an input interconnect unit 104 can couple with a bypass switching system 110 wherein this coupling identifies a first signal path 112. Likewise, a bypass switch system can couple with an output interconnect unit 106 wherein this coupling can identify a second signal path 114. The embodiment depicted in FIG. 1 further represents that a signal effects unit 108 can couple with a bypass switch system 110, wherein this coupling can identify a third signal path, 116, and a fourth signal path, 118.

Figure 2:
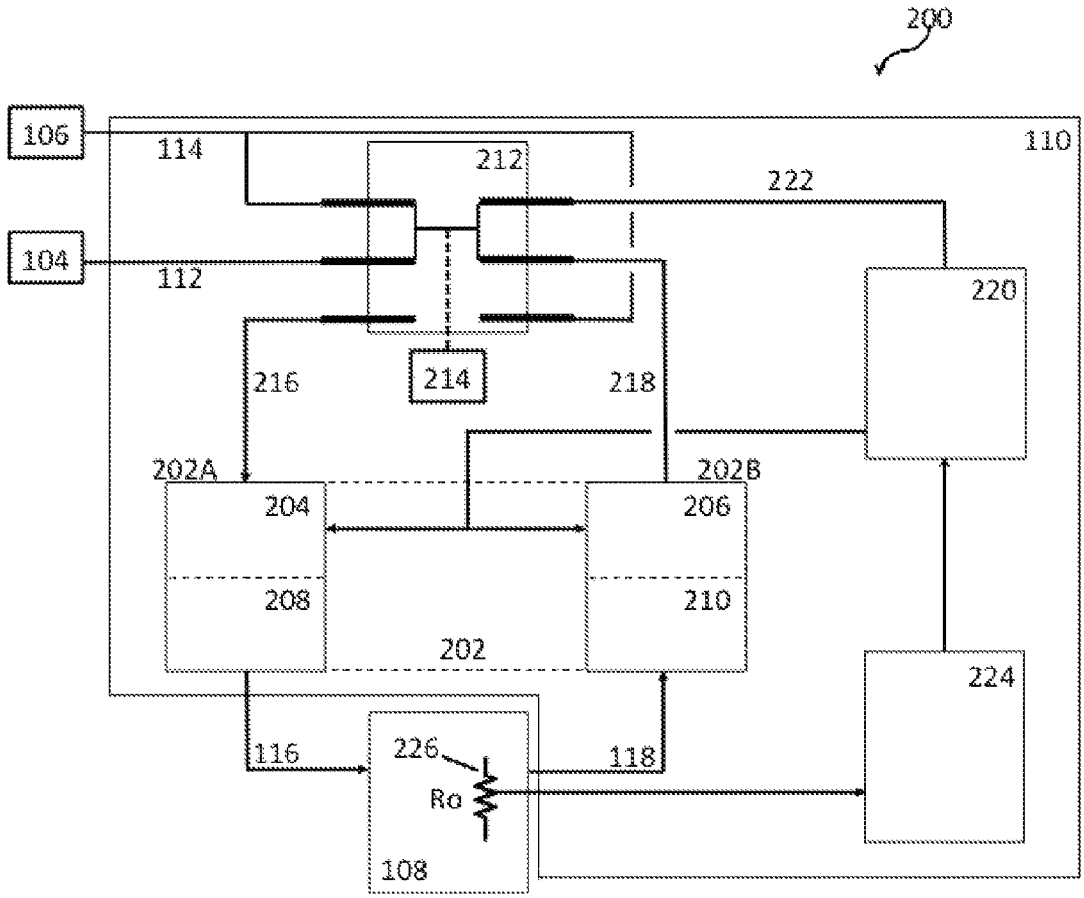
FIG. 2 depicts a detailed diagram of the bypass switching system.

FIG. 2 depicts a diagram of an embodiment of a signal processing system 200 comprising a bypass switching system 110. As depicted, the bypass switching system 110 can comprise a switch state detection unit 220, signal a conditioning unit 202 consisting of an input signal conditioning unit 202A and an output signal conditioning unit 202B, and a signal switching unit 212. The signal switching unit 212 can further comprise a switch actuation control 214. In some embodiments the switch activation control 214 can be incorporated into the signal switching unit 212. In alternate embodiments, the actuation control 214 can be located within the bypass switching system 110 but separately from the signal switching unit 212. In other alternate embodiments, the activation control 218 can be a remotely generated signal.

In alternate embodiments, the bypass switching system 110 can further comprise a low impedance feedback unit, 224. In such embodiments, the low impedance feedback unit 224 can couple with the output impedance 226 of the signal effects unit 106 and/or with the switch state detection unit 220.

As depicted in the embodiment shown in FIG. 2, the signal switching unit 212 can couple with an input signal conditioning unit 202A, wherein this coupling identifies a fifth signal path 216. The signal switching unit further couples with an output signal conditioning unit 202B, wherein this coupling identifies a sixth signal path 218. In some embodiments, signal path 116 can be identified when an input signal conditioning unit 200A is coupled with a signal effects unit 106. Likewise, a signal path 118 can be identified when a signal effects unit 106 is coupled with an output signal conditioning unit 202B.

Signal conditioning units 202 reduce and/or minimize a signal amplitude and/or eliminate unwanted transient signals propagating inactive or suspended signal paths 216, 218, 116, and 118. In one embodiment, signal conditioning units 202A and 202B automatically constrain signals exceeding a threshold. In alternate embodiments, signal conditioning units 202A and 202B reduce or diminish amplitudes of signals under external control. In other alternate embodiments, signal conditioning units 202A and 202B can implement both an automatic and controlled reduction of signal amplitudes, and/or may be absent.

In some embodiments, automatic constraint of signal amplitude can be implemented with circuitry comprising an operational amplifier. In alternate embodiments, automatic constraint can be implemented with circuitry comprising an embedded controller. In yet other embodiments, automatic constraint can be implemented with circuitry comprising ASICs, transistor networks, modulating circuits and/or any other known and/or convenient circuit or device capable of or adapted to constraining a signal to a specified threshold.

In alternate embodiments, controlled reduction of signal amplitude can be implemented with circuitry comprising an operational amplifier. In an alternate embodiment, controlled reduction or diminution of signal amplitude can be implemented with circuitry comprising an embedded controller. In yet other alternate embodiments, controlled reduction or diminution of signal amplitude can be implemented with circuitry comprising ASICs, transistor networks, modulating circuits and/or any other known and/or convenient circuit or device capable of or adapted to reducing or diminishing a signal amplitude in response to a controlling signal.

As depicted in FIG. 2, an input signal conditioning unit 202A can comprise an input automatic gain control 208 and an input supervised gain control 204. Likewise, an output signal conditioning unit 202B can comprise an output automatic gain control 210 and an output supervised gain control 206. In such embodiments an input supervised gain control 204 can couple with an output supervised gain control 206. In the embodiment depicted in FIG. 2, input supervised gain control 204 and output supervised gain control 206 couple with switch state detection unit 220.

A signal switching unit 212 can receive an actuating signal from an activating device 214. In multimodal embodiments, an activating device 214 can stipulate a specific mode from a plurality of possible system operating modes. In alternate bimodal embodiments, device 214 can stipulate one of two operating modes. In other embodiments, device 214 can be incorporated into the switching system 212. In still further alternate embodiments, device 214 can be remote to the switching system 212.

A signal switching unit 212 can change the operational mode of a bypass switching system 110 by rerouting signal paths inherent to the bypass switching system 110. In some embodiments, a signal switching unit 212 can route a plurality of input signal paths to an equal number of output signal paths in any random and/or stipulated combination or pattern. In alternate embodiments, a switching system 212 can implement a bimodal system. Some bimodal embodiments can include a signal effects unit 108 in the signal path. Alternate bimodal embodiments can route the signal path to bypass or exclude a signal effects unit 108.

In some embodiments, a signal switching unit 212 can be implemented with a crossbar switch. In alternate bimodal embodiments, a signal switching unit can be implemented with a multi-pole double throw switch. In further alternate embodiments, a signal switching unit 212 can be implemented using relays. Still other embodiments can use mechanical relays, solid state relays, embedded processors, and/or circuitry comprising transistor networks, ASICs and/or any other known and/or convenient circuit or device capable of or adapted to uniquely coupling any input signal path with any other output signal path.

A switch state detection unit 220 can couple with a signal switching unit 212 to identify a switch state sense signal 222. In such embodiments, a switch state detection unit 220 can measure the condition of a signal switching unit 212. A detection unit 220 can determine the present mode of switch operation by measuring some or all of the state variables characterizing a signal switching unit 212. A control signal indicative of the operational state of the signal switching unit 212 can be developed. A time interval between measure a state of a signal switching unit 212 and issuing a control signal can be used to control the timing of subsequent events. In alternate embodiments, a switch state detection unit 220 can receive a control signal from a low impedance feedback unit 224 and can use this control signal to abort a control signal.

In some embodiments, a switch state detection unit 220 can be implemented with circuitry comprising multistable multivibrator or flip-flop devices. In alternate embodiments, a switch state detection unit 220 can be implemented with circuitry comprising an embedded controller. In yet other alternate embodiments, a switch state detection unit 220 can be implemented with circuitry comprising timers, ASICs, transistor networks, and/or any other known and/or convenient circuits or devices capable of or adapted to measuring state variables and issuing timing/control signals indicative of a present operating state.

A low impedance feedback unit 224 can conditionally disable a switch state detection unit 220 based upon the magnitude of the signal effects unit 108 output resistance 226. A low impedance feedback unit 224 can measure the magnitude of the current and voltage inherent in the output of signal effects unit 108 and can use this information to develop a control signal indicating that the magnitude of an output resistance 226 exceeds a threshold value. In some embodiments, a low impedance feedback unit 224 can be implemented with a with circuitry comprising voltage comparator, an transistor network, a diode network and/or any other known and/or convenient circuit or device capable of or adapted to measuring the current/voltage relationship of a device and issuing signals indicative of the magnitude of this relationship.

Figures 3, 3A:
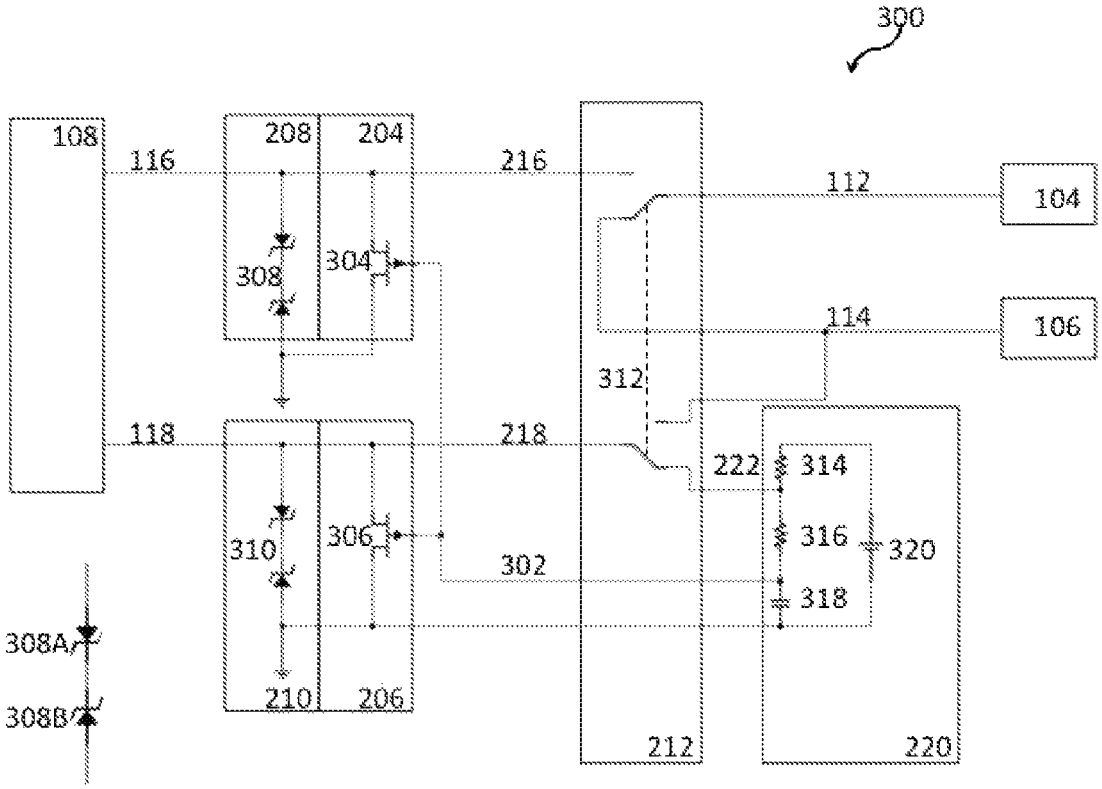
FIG. 3 depicts an alternate embodiment of a bypass switching system

FIG. 3 schematically depicts an embodiment of a bypass switching system 300, comprising a signal switching unit 212, an input supervised gain control 204, an output supervised gain control 206, an input automatic gain control 208, an output automatic gain control 210 and a switch state detection unit 220.

As depicted in FIG. 3, in such embodiments supervised gain controls 204 and 206 can be implemented with solid state circuits comprising transistors, bipolar junction transistors, field effect transistors (FET) and/or any other known and/or convenient circuits or devices capable of and/or adapted to changing an impedance under the control of an external operator. In such embodiments, an input supervised gain control FET 304 can implement an input supervised gain control 204 and an output supervised gain control FET 306 can implement an input supervised gain control 206. In alternate embodiments an input supervised gain control FET 304 and/or an output supervised gain control FET 306 can be a p-JFET.

As depicted in FIG. 3, in such embodiments the gate of input supervised gain control FET 304 can couple with the gate of output supervised gain control FET 306 and, together, an input supervised gain control FET 304 and an output supervised gain control FET 306 can couple with a switch state detection unit 220. A coupling of the gates of FET 304 and FET 306 with a switch state detection unit 220 can identify a switch state control signal 302.

Furthermore, in such embodiments as depicted in FIG. 3, automatic gain controls 208 and 210 can be implemented with solid state circuits comprising transistors, diodes, zener diodes and/or any other known and/or convenient circuits or devices capable of and/or adapted to automatically regulating the amplitude of an electrical signal. In such embodiments, an input automatic gain control diode circuit 308 comprising opposing zener diodes can implement an input automatic gain control 208 and an output automatic gain control diode circuit 310 comprising opposing zener diodes can implement an output automatic gain control 210. In some embodiments, the opposing zener diode pair can operate to provide electrostatic discharge protection for the bypass switching system 300.

As depicted in FIG. 3*a*, in some embodiments, the symmetry of the opposing diodes can set limits for both negative and positive trending signals. In some embodiments, zener diode 308A can couple with opposing zener diode 308B. In alternate embodiments, a signal limit threshold can be modified when zener diode 308A and zener diode 308B both couple with an interposed resistive element.

As depicted in FIG. 3, a switch state detection unit 220 can be implemented with embedded processors, solid state circuits, passive element circuits and/or any other known and/or convenient circuits or devices capable of and/or adapted to measuring state variables and issuing timing/control signals indicative of a present operating state. In some embodiments as depicted in FIG. 3, an RC circuit comprising a first resistive element 314, a second resistive element 316, a capacitive element 318, and/or a DC voltage source 320 comprising a positive terminal and a negative terminal can implement a switch state detection unit 220. In some embodiments, a first resistive element 314 can couple with a second resistive element 316, and together they can couple with a double pole double throw switch, 312, via a switch state sense signal 222. A second resistive element 316 can couple with a capacitive element 318 and together a second resistive element 316 and capacitive element 318 can couple with the gates of the gain control FETS 304 and 306 via a switch state control signal 302.

In the embodiment depicted in FIG. 3, a switch state detection unit 220 implemented as a first resistive element 314 coupled with a second resistive element 316, which is coupled with a capacitive element 318 can establish an RC circuit. In such embodiments a first resistive element 314 can couple with the positive terminal of a DC voltage source 320 and a capacitive element 318 can couple with the negative terminal of a DC voltage source. As implemented is FIG. 3, a rise time of a switch state control signal 302 can be established by a first resistive element 314 and a fall time of a switch state control signal 302 can be established by a second resistive element 316. In alternate embodiments, a first resistive element 314 can be a factor of ten greater than a second resistive element 316. However in still further alternate embodiments, a first resistive element 314 and a second resistive element 316 can have known, convenient and/or desired resistivity ratio.

Figure 4:
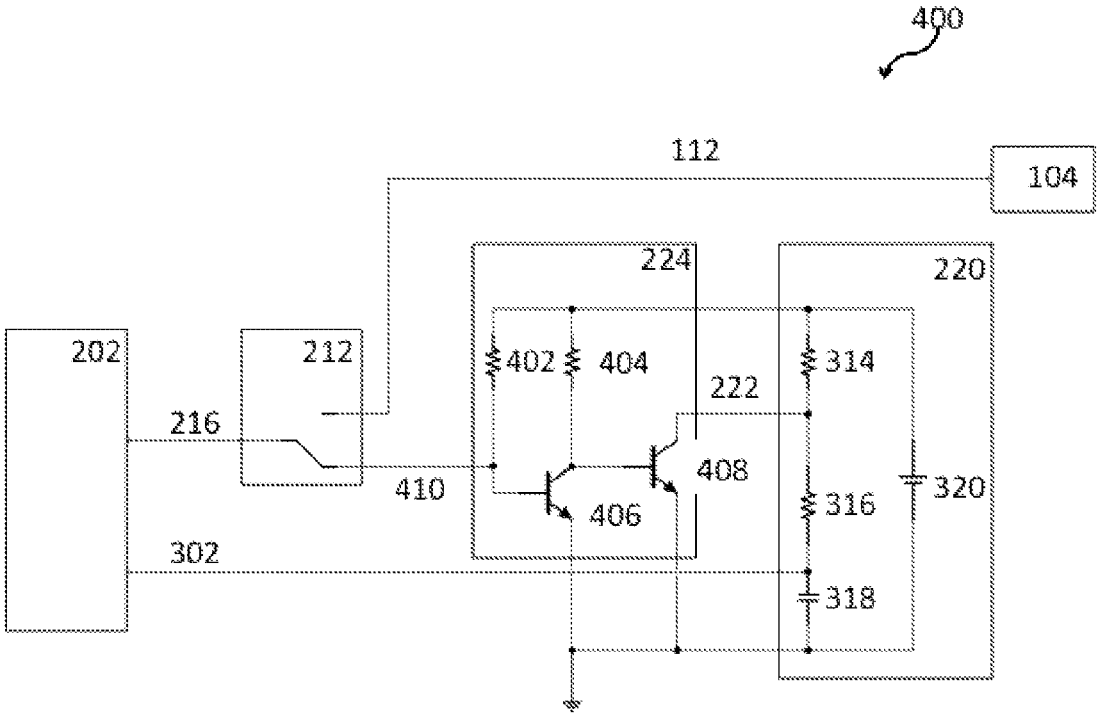
FIG. 4 depicts an alternate embodiment of a bypass switching system comprising a low impedance detection unit

FIG. 4 schematically depicts an alternate embodiment of a bypass switching system 400 comprising a low impedance detection unit 224. In such embodiments, a low impedance detection unit can comprise a third resistive element 402, a fourth resistive element 404, a first bipolar junction transistor 406 and/or a second bipolar junction transistor 408. A third resistive element 402 can be coupled with a fourth resistive element 404, and together they can be coupled with a DC voltage source 320. The third resistive element 402, can further couple with the base of transistor 406 and together a fourth resistive element 404 and the collector of transistor 406 can couple with the base of transistor 408. A first resistive element 314 can couple with the collector of transistor 408 and together a first resistive element 314 and the collector of transistor 408 can couple with a second resistive element 316 and capacitive element 318. Coupling a signal switch unit 212 with the base of transistor 406 can identify a low impedance sense signal 410.

Figures 5, 5A, 5B, 5C, 5D, 5E:
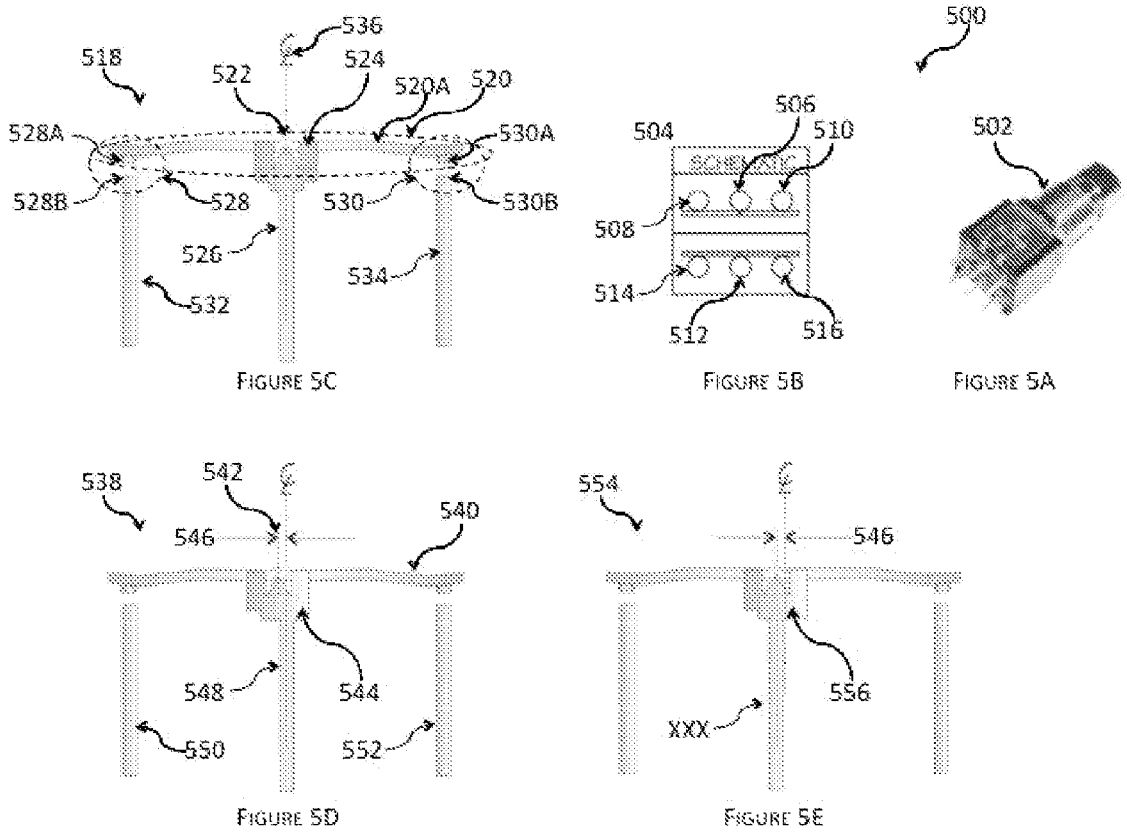
FIG. 5 depicts an asymmetrical double pole double throw switch

FIGS. 5A-D depict various views of an embodiment of an asymmetrical double pole double throw (DPDT) switch 500. In such embodiments an asymmetrical DPDT switch 502 can be an electromechanical device comprising an on-axis single pole double throw switch 518 and a second off-axis single pole double throw switch 538 arranged for simultaneous parallel operation. Each single pole double throw switch can further comprise a pair of electrical contacts 528 and 530 wherein a set of contacts can be in one of two states: contact closure, wherein a contact can electrically conduct a current or propagate a signal, or contact open, wherein a contact cannot electrically conduct a current or propagate a signal. FIG. 5A depicts an asymmetrical double pole double throw switch 502 wherein an asymmetrical DPDT switch can comprise a pin bed 504 configured to carry six electrically conductive pins 506, 508, 510, 512, 514, 516, arranged in two rows of three electrically conductive pins each.

FIG. 5C depicts the mechanical details of an on-axis single pole double throw switch 518. An on-axis single pole double throw switch can comprise an on-axis rocker arm assembly 520, a fulcrum assembly 524, a first contact closure 528, a second contact closure 530, a switch common post 526, a normally closed post 532 and/or a normally open post 534. In such embodiments a fulcrum assembly 524 can couple with a switch common post 526.

As further depicted in FIG. 5C, an on-axis rocker arm assembly 520 can further comprise an on-axis rocker arm 520A, an on-axis switch rocker pivot point 522, a contact pad 528A biased to a closed position and a contact pad 530A biased to an open position. As depicted, an on-axis switch rocker pivot point 522 can be embedded into an on-axis rocker arm 520A. A normally open contact pad 530A can be affixed to one end of an on-axis rocker arm 520A and a normally closed contact pad 528A can be affixed to the other end. An on-axis single pole double throw switch can be characterized by a line of symmetry collinear with a switch centerline 536 and bisecting an on-axis rocker arm 520A normal to and at the on-axis switch rocker pivot point 522 wherein an on-axis switch rocker pivot point 522 is equidistant from either end of an on-axis rocker arm 520A.

As depicted in FIG. 5C, a fulcrum assembly 524 can couple with an on-axis switch rocker pivot point 522 enabling a rocker arm assembly 520 to pivot about a fulcrum assembly 524. A first contact closure 528 can comprise a normally closed contact pad 528A and normally closed contact landing 528B wherein the normally closed contact landing 528B can be in electrical contact with the normally closed contact pad 528A. A second contact closure 530 can comprise a normally open contact pad 530A and normally open contact landing 530B wherein the normally open contact landing 530B can be in electrical contact with the normally open contact pad 530A. In such configurations, a rocker arm assembly 520 can be operated such that a switch common post 526 is in electrical contact with a first contact closure 528, a second contact closure 530, with both first and second contact closures 528 and 530, and/or neither contact closures 528 and 530. As yet further depicted in FIG. 5C, a normally closed contact landing 528B can be coupled with a normally closed post 532 and a normally open contact landing 530B can be coupled with a normally open post 534.

FIG. 5D depicts the mechanical details of an off-axis single pole double throw switch 538. An off-axis single pole double throw switch can comprise an on-axis rocker arm assembly 540, an off-axis switch rocker pivot point 542, an off-axis switch fulcrum assembly 544, an off-axis switch common post 548, an off-axis switch normally closed post 550, and/or an off-axis switch normally open post 552. In such embodiments a fulcrum assembly 544 can couple with a switch common post 548.

As depicted in the embodiment shown in FIG. 5D, an off-axis single pole double throw switch 538 can be characterized by an off-axis displacement 546 between an off-axis switch rocker pivot point 542 and a switch centerline 536. An off-axis switch fulcrum assembly 544 can couple with an off-axis switch rocker pivot point 542 enabling an off-axis switch rocker arm assembly 540 to pivot about a fulcrum assembly 544. Furthermore, an off-axis switch fulcrum assembly 544 can couple with an off-axis switch common post 548.

As depicted in the embodiment depicted in FIGS. 5B, 5C, and 5D, electrically conductive pins 506, 508, 510, can be coupled with an on-axis single pole double throw switch 518 wherein a common pin of an on-axis switch 506 can be couple with a switch common post 526, a normally closed pin of an on-axis switch 508 can be couple with a normally closed post 532, and/or a normally open pin of an on-axis switch 510 can be couple with a normally opened post 534. Electrically conductive pins 512, 514, 516, can be coupled with an off-axis single pole double throw switch 536 wherein a common pin of an off-axis switch 512 can be couple with an off-axis switch common post 548, a normally closed pin of an off-axis switch 514 can couple with an off-axis normally closed post 550, and/or a normally open pin of an off-axis switch 516 can be couple with an off-axis normally open post 552.

As depicted in the embodiment depicted in FIG. 5D, in some embodiments, an off-axis switch fulcrum assembly 544 can be fabricated to preserve a switch centerline 536 alignment of an on off-axis switch common post 548. In such embodiments, the off-axis switch fulcrum assembly 544 can be fabricated with an off-axis displacement 546 between the fulcrum and the centerline of an off-axis switch common post 548. In alternate embodiments, as depicted in FIG. 5E, an off-axis switch fulcrum assembly 544 can be fabricated to preserve the symmetry of the assembly. In such embodiments, the off-axis switch fulcrum assembly 544 can be coupled with an off-axis switch common post 548 such that an off-axis switch fulcrum assembly 544 and an off-axis switch common post 548 are collinear. Together, an off-axis switch fulcrum assembly 544 and an off-axis switch common post 548 are offset from a switch centerline 536 by an off-axis displacement 546.

An asymmetrical double pole double throw switch can comprise an actuator assembly constructed as a biased and/or spring-biased mechanism whereby the actuator controls the contact positions of the switch. In such embodiments, the actuator can couple with a surface of a rocker arm assembly 520 opposite of the surface comprising the electrical contacts 528A and 530A. Switch state transitions can be achieved by causing an actuator to traverse over the surface of a rocker arm assembly such that the actuator crosses back and forth over the pivot. In alternate embodiments, the actuator can be slotted with two pairs of stationary offset contacts.

Figure 6:
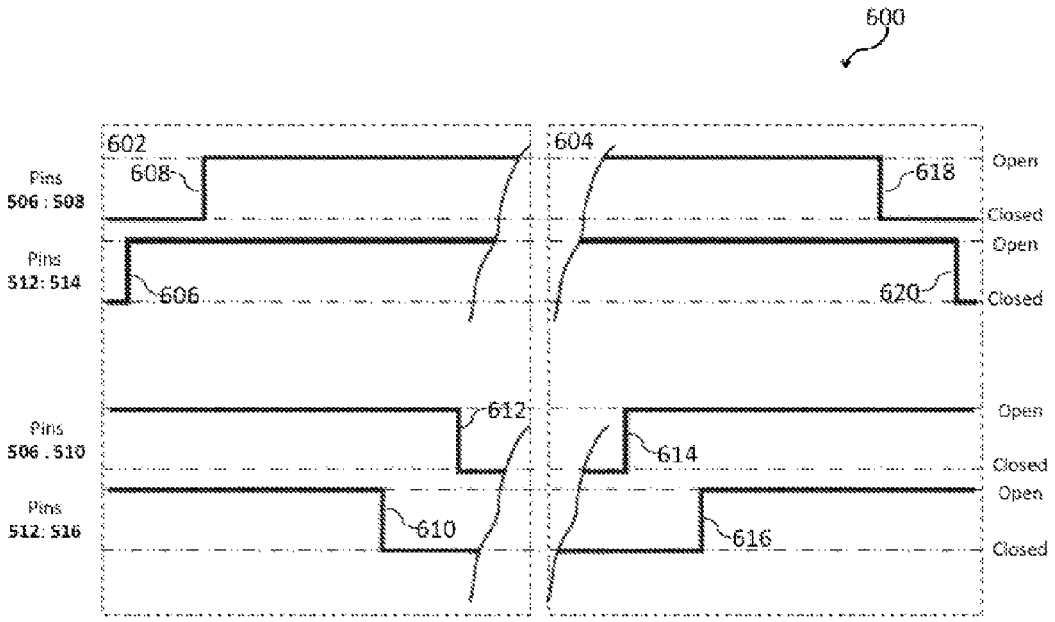
FIG. 6 is a state transition timing diagram depicting a switching sequence embodiment of an asymmetrical double pole double throw switch.
Figure 7:
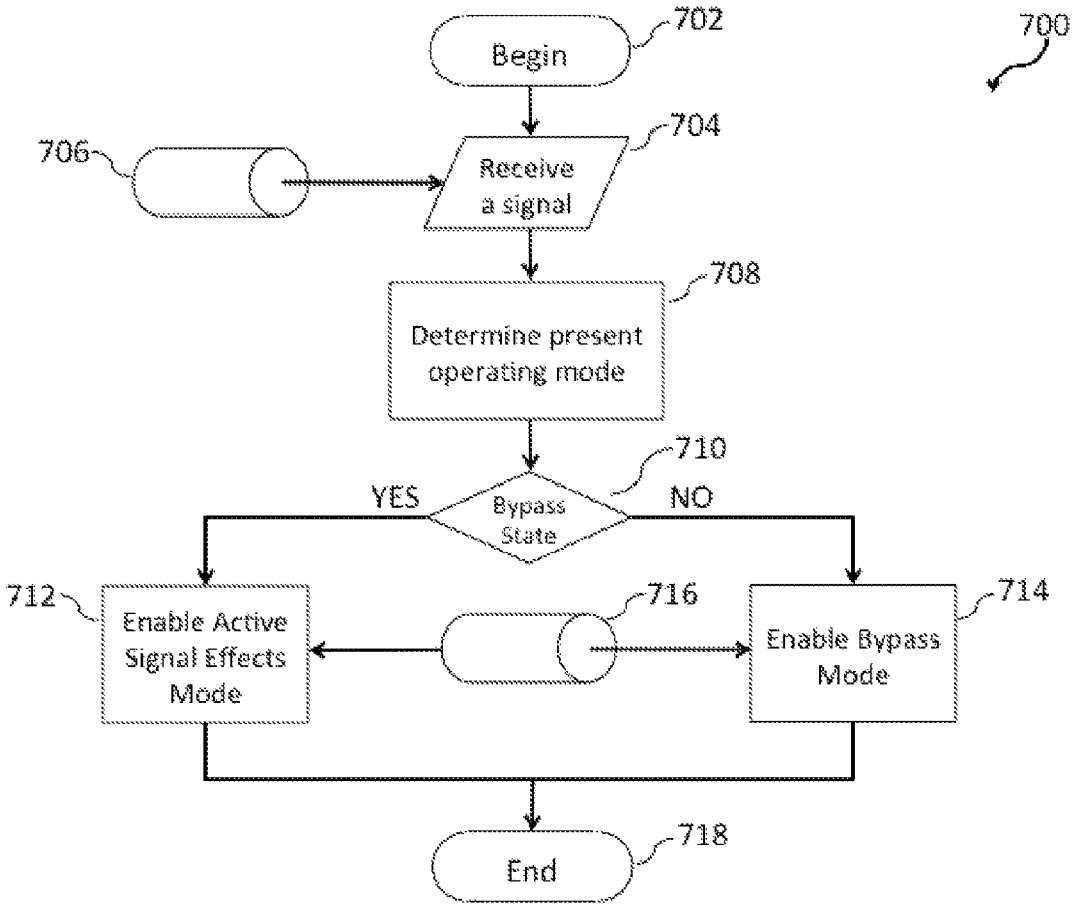
FIG. 7 depicts an embodiment of a method for changing modes.

FIG. 6 is an embodiment of a state transition timing diagram depicting a switching sequence 600 of an asymmetrical double pole double throw switch. In such embodiments, a state transition timing diagram 600 comprises a first state transition 602, a second state transition 604, opening switch contacts 606, 608, 614, and 616, and closing switch contacts 610, 612, 618, and 620.

A first state transition 602 can begin with opening switch contacts 606 coupled with electrically conductive pins 512, and 514. A first contact closure 528 of an off-axis switch 538 can be open. After a prescribed period of time, a switching sequence 600 can proceed to opening switch contacts 608 coupled with electrically conductive pins 506, and 508. A first contact closure 528 of an on-axis switch 528 can be open. After a prescribed period of time, a switching sequence 600 can proceed to closing switch contacts 610, and 612.

A first state transition 602 continues with closing switch contacts 610 coupled with electrically conductive pins 512, and 516. A second contact closure 530 of an off-axis switch 538 can be closed. After a prescribed period of time, a switching sequence 600 can proceed to closing switch contacts 612 coupled with electrically conductive pins 506, and 510. A second contact closure 530 of an on-axis switch 528 can be closed. A state transition 602 can be concluded.

A second state transition 604 can begin with opening switch contacts 614 coupled with electrically conductive pins 506, and 510. A second contact closure 530 of an on-axis switch 518 can be open. After a prescribed period of time, a switching sequence 600 can proceed to opening switch contacts 616 coupled with electrically conductive pins 512, and 516. A second contact closure 530 of an off-axis switch 538 can be open. After a prescribed period of time, a switching sequence 600 can proceed to closing switch contacts 618, and 620.

A second state transition 604 continues with closing switch contacts 618 coupled with electrically conductive pins 506, and 508. A second contact closure 528 of an on-axis switch 518 can be closed. After a prescribed period of time, a switching sequence 600 can proceed to closing switch contacts 620 coupled with electrically conductive pins 512, and 514. A second contact closure 528 of an off-axis switch 538 can be closed. A state transition 604 can be concluded.

An embodiment of a method for changing modes 700, can comprise the steps of receiving a signal 704 from a state command signal 706, determining the present state of operation for a signal processing device 708, deciding to enable active signal effects 712 if present mode is bypass signal effects 710, alternatively or deciding to bypass signal effects 714 if present mode is active signal effects 710.

Method 700 can begin at step 702 and can proceed to step 704. At step 704 a change of state command signal 706 can be received. A change of state command signal 706 can have remote origins or can be generated locally within said signal processing device 100. Thereafter, the method 700 can proceed to step 708.

At step 708 a present operating state can be determined. A determination can be made by comparing operational attributes of the present state with a canonical set of attributes consistent with known operating states. Thereafter, the method 700 can proceed to step 710.

At step 710, a present operation state consistent with a bypass signal effects mode can be made. Thereafter method 700 can proceed to step 712 or step 714 depending upon the determined bypass state. At step 712 a procedure to change modes to enable signal effects can be invoked. In this mode, a signal 716 can be modified by a signal effects unit 100. Thereafter method 700 can proceed to and end at step 718.

At step 710, a present operation state consistent with a active signal effects mode can be made. Thereafter method 700 can proceed to step 714. At step 714 a procedure to change modes to bypass signal effects can be invoked. In this mode, a signal 716 can be routed to bypass a signal effects unit 100. Thereafter method 700 can proceed to and end at step 718.

Figure 8:
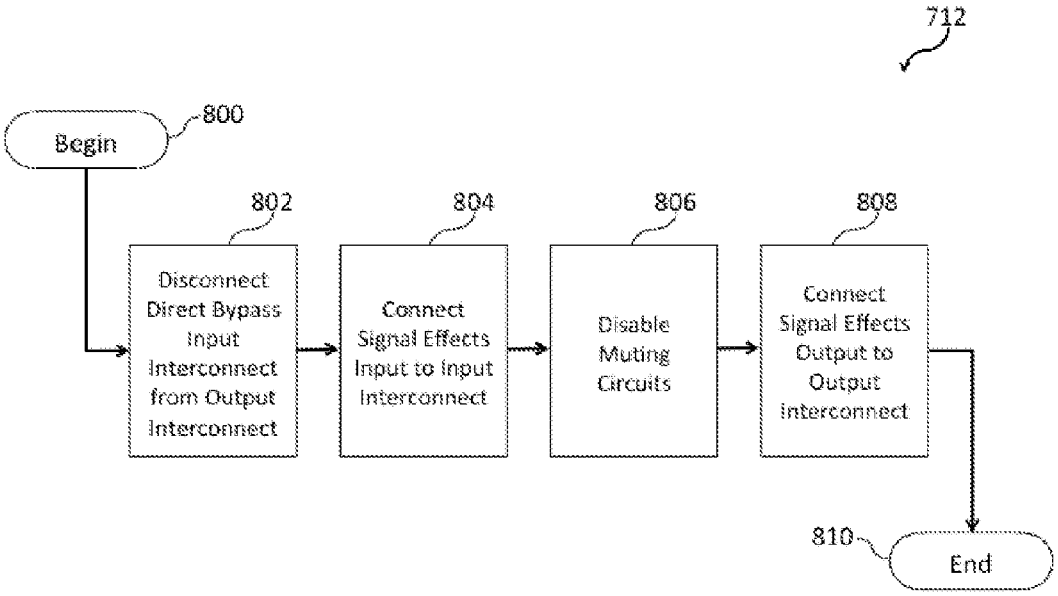
FIG. 8 depicts an embodiment of the steps to enable an active signal effects mode.

FIG. 8 depicts an embodiment of step 712 comprising the steps to enable an active signal effects mode. Step 712 can be a sequence of steps comprising disconnecting the bypass between the input interconnect and output interconnect 802, connecting the signal effect unit input to the input interconnect 804, disabling the muting circuits 806, and connecting the signal effect unit output to the output interconnect 808. In some embodiments, the step of disabling the muting circuits 806 can precede the step of connecting the signal effect unity input to the input interconnect 804.

At step 800 the signal effect unit can be inactive and can be removed from the signal path by directly coupling an input interconnect 102 to an output interconnect 104 completing a bypass circuit. Thereafter the method can proceed to step 802.

At step 802 a bypass circuit can be disabled by disconnecting an input interconnect 102 from an output interconnect 104. Thereafter the method can proceed to step 804.

At step 804 pausing for a prescribe time, switching transients from step 802 can decay and an input for a signal effects unit can be coupled with and input interconnect 102. Thereafter the method can proceed to step 806.

At step 806 pausing for a prescribe time, possible switching transients from step 804 can decay and a muting circuit can be disabled. Thereafter the method can proceed to step 808. However, in some embodiments steps 804 and 806 can be performed in any desired order such that step 806 is performed prior to step 804 and step 808 can follow step 804 or step 806.

At step 808 pausing for a prescribe time, possible switching transients from step 804 can decay and an output for a signal effects unit can be coupled with an output interconnect 104. Thereafter a signal effects unit is enabled; the method can proceed to and end at step 810.

Figure 9:
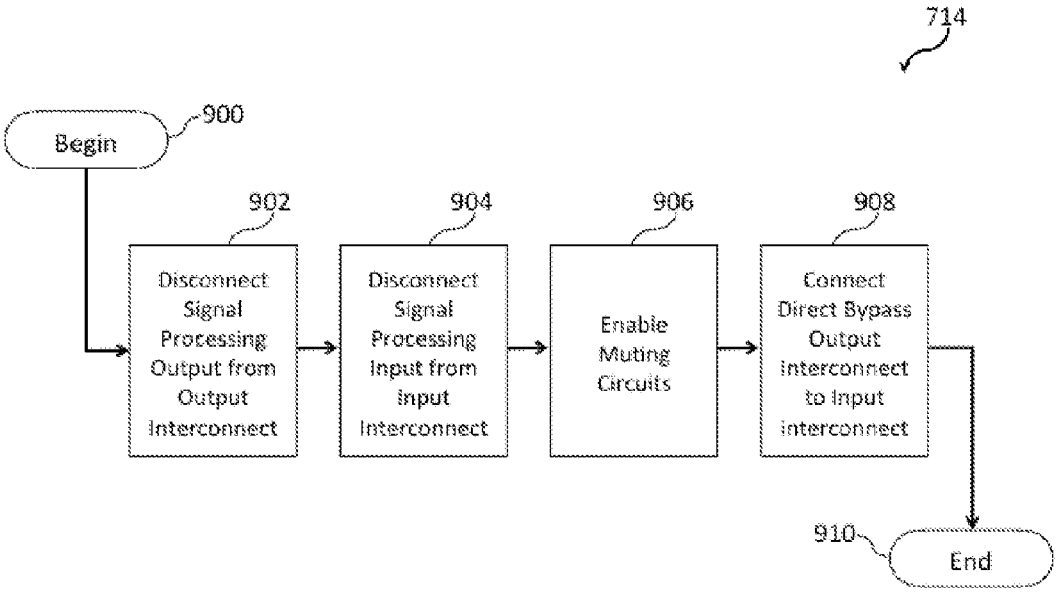
FIG. 9 depicts an embodiment of the steps to effect a signal bypass mode.

FIG. 9 depicts an embodiment of step 714 comprising the steps to effect a signal bypass mode. Step 714 can be a sequence of steps designed to minimize or avoid switching transients while deactivating a signal effects unit 106 comprising disconnecting the signal effect unit output from the output interconnect 902; disconnecting the signal effect unit input to the input interconnect 904; enabling the muting circuits 906; and connecting bypass between the input interconnect and output interconnect 908.

Step 714 begins at step 900 wherein the signal effect unit can be active and coupled with an input interconnect 102 and an output interconnect 104. Thereafter the method can proceed to step 902.

At step 902 a signal effects unit 106 can be disabled by disconnecting an output of the signal effects unit 106 from an output interconnect unit 104. Thereafter the method can proceed to step 904.

At step 904 pausing for a prescribe time, possible switching transients from step 902 can decay and an input for a signal effects unit 106 can be disconnected from an input interconnect unit 102. Thereafter the method can proceed to step 906.

At step 906 pausing for a prescribe time, possible switching transients from step 904 can decay and muting circuits can be enabled. Thereafter the method can proceed to step 908.

At step 908 pausing for a prescribe time, possible switching transients from step 904 can be eclipsed and a direct signal effect unit can be inactivated and removed from a signal path by directly coupling an input interconnect 102 to an output interconnect 104 completing a bypass circuit. Thereafter the method can proceed to and end at step 910.

A signal processing device 100 can be a system configured to switch between a first state and a second state while mitigating, minimizing and/or avoiding switching transients. In some embodiments a first state can characterize an active signal effects mode and a second state can characterize an inactive signal effects mode. Functionally, a signal processing device 100 can comprise automatic gain control, supervised gain control, muting, low-impedance feedback and/or state transitions executing a sequence set of actions leading to a subsequent state.

Figure 10:
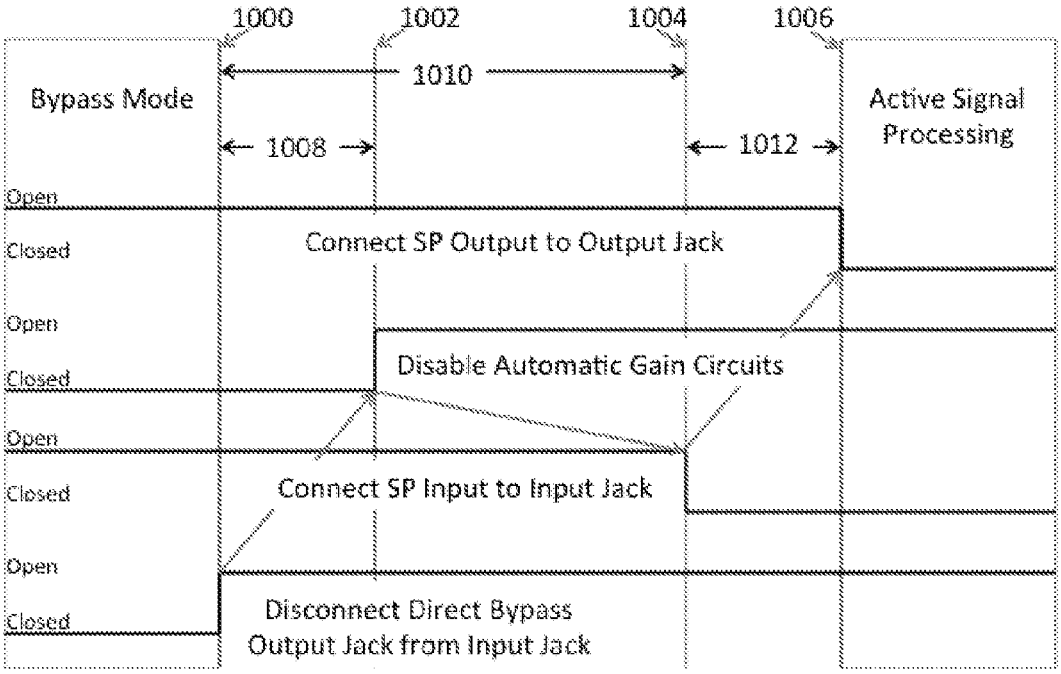
FIG. 10 depicts a state transition from a bypass mode to an active signal effects mode comprising a set of actions.

FIG. 10 depicts a state transition from a bypass mode to an active signal effects mode comprising a set of events which can include: disconnecting the direct bypass 1000 between an input interconnect unit 104 and an output interconnect unit 106, disabling the supervised gain control circuits 1002, connecting a signal effects input to an input interconnect 1004, and connecting a signal effect unit output to an output interconnect 1006, wherein each event can be associated with a prescribed subset of actions.

Event 1000 can comprise disconnecting a direct bypass by opening a connective path between an input interconnect 104 and an output interconnect 106 resulting in an interruption of a bypass signal. After event 1000 pausing for a prescribed period of time 1008 can permit any switching transients resulting from interrupting a bypass signal to diminish before proceeding to event 1002.

At event 1002, disabling a supervised gain control circuit (s) can result in an increase in the amplitude of the signals present at the input and output of the signal effects unit 106. After event 1002, pausing for a prescribed period of time 1010 can permit the signals to stabilize before proceeding to event 1004. In some embodiments the signals can be stabilized at their full amplitude. However, in alternate embodiments the signals can be stabilized at any known, convenient and/or desired amplitude and/or having any known, convenient and/or desired properties. In some embodiments, supervised gain can include muting a signal and/or providing low-impedance feedback.

At event 1004, connecting a input to a signal effects unit 108 to an input interconnect unit 104 can close a connective signal path between a signal effects unit 108 and an input interconnect unit 104 resulting in incoming signals accessing a signal effects unit 108. After 1004, pausing for a final prescribed period of time 1012 can permit any switching transients resulting from connecting a signal effects input to an input interconnect to diminish.

At event 1006 connecting a signal effect unit 108 output to an output interconnect unit 106 can close a connective signal path between a signal effects unit 108 and an output interconnect unit 106 resulting in a complete signal path from an input interconnect unit 104, through a signal effects unit 108 and to the output interconnect 106.

Figure 11:
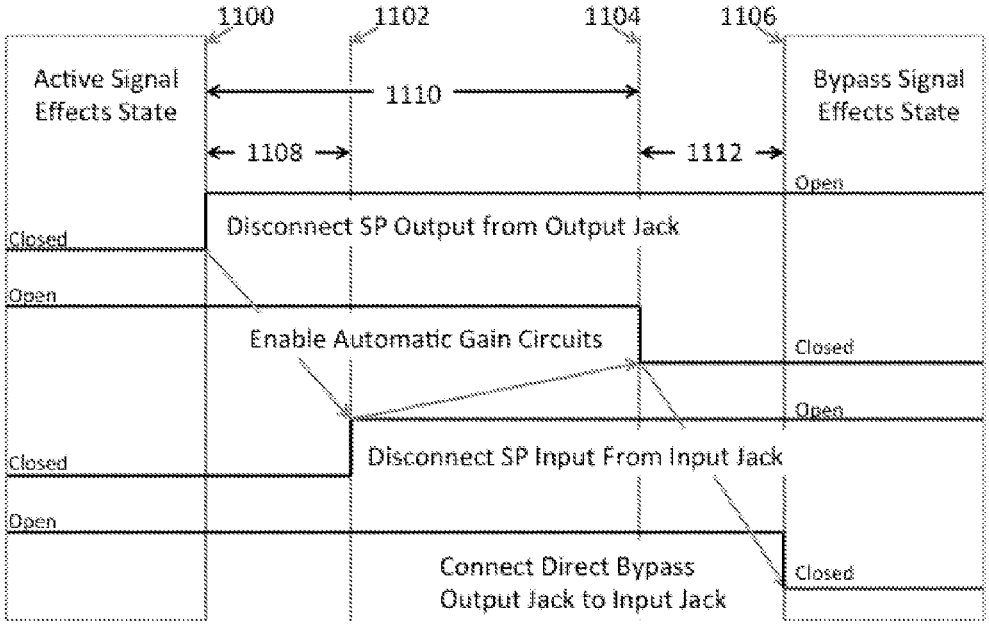
FIG. 11 depicts a state transition from an active signal effects mode to a bypass signal effects mode comprising a set of actions.

FIG. 11 depicts a state transition from an active signal effects mode to a bypass signal effects mode comprising a set of events including disconnecting a signal effects unit from the output interconnect 1100, enabling the supervised gain control circuits 1102, disconnecting a signal effects unit from an input interconnect 1104, and connecting a direct bypass 1106. In some embodiments, event 1104 can precede event 1102.

At event 1100, disconnecting a signal effects unit 108 from the output interconnect unit 106, can open a connective path between a signal effects unit 108 and an output interconnect unit 106 resulting in an interruption of any signal propagation from the signal effects unit 108. After event 1100 pausing for a prescribed period of time 1108 can permit any switching transients resulting from interrupting a bypass signal to diminish before proceeding to event 1102.

At event 1102 disconnecting a signal effects unit 108 from the input interconnect unit 104, can open a connective path between a signal effects unit 108 and an input interconnect unit 104 resulting in an interruption of any signal propagation from the signal effects unit 108. After event 1102 pausing for a prescribed period of time 1110 can permit any switching transients resulting from interrupting any signal propagation from the signal effects unit to diminish before proceeding to event 1104.

At event 1104 enabling a signal conditioning unit 202 can result in a decrease in the amplitude of the signals present at the input and output of the signal effects unit 106. After event 1104 pausing for a final prescribed period of time 1112 can permit any switching transients to diminish before proceeding to event 1106.

At event 1106 connecting a direct bypass by closing a connective path between an input interconnect unit 104 and an output interconnect unit 106 can result in signal path excluding the signal effects unit 108.

Figure 12:
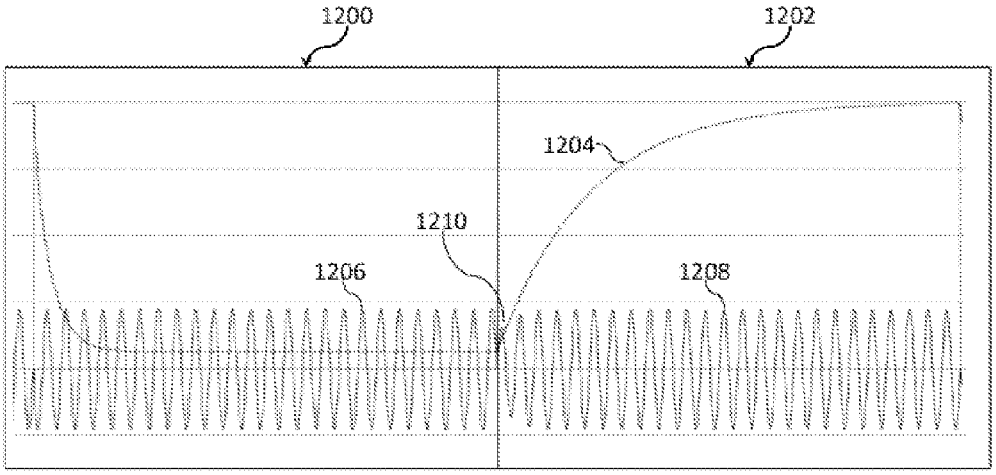
FIG. 12 depicts a demonstration that can result from supervised gain control.

FIG. 12 depicts a potential exemplar that can result from supervised gain control. In some embodiments a signal processing device 100 can be configured to switch between a first state, characterizing a bypass signal effects mode 1200, and a second state, characterizing an active signal effects mode 1202. A switch state control signal 1204 can indicate the present state occupied by the signal processing unit 100.

A low value for a switch state control signal 1204 can indicate a bypass signal effects mode 1200. Alternatively, a high value for a switch state control signal 1204, can indicate an active signal effects mode 1202. The signal level of a switch state control signal 1204 can be used as a control signal to the supervised gain control.

In a bypass signal effects mode, a signal 1206 can be routed from the input interconnect 104 directly to the output interconnect 106, bypassing the signal effects unit 108. Alternatively, in an active signal effects mode, a signal 1206, can be routed through a signal effects unit resulting in signal 1208 after amplitude recovery 1210.

Figure 13:
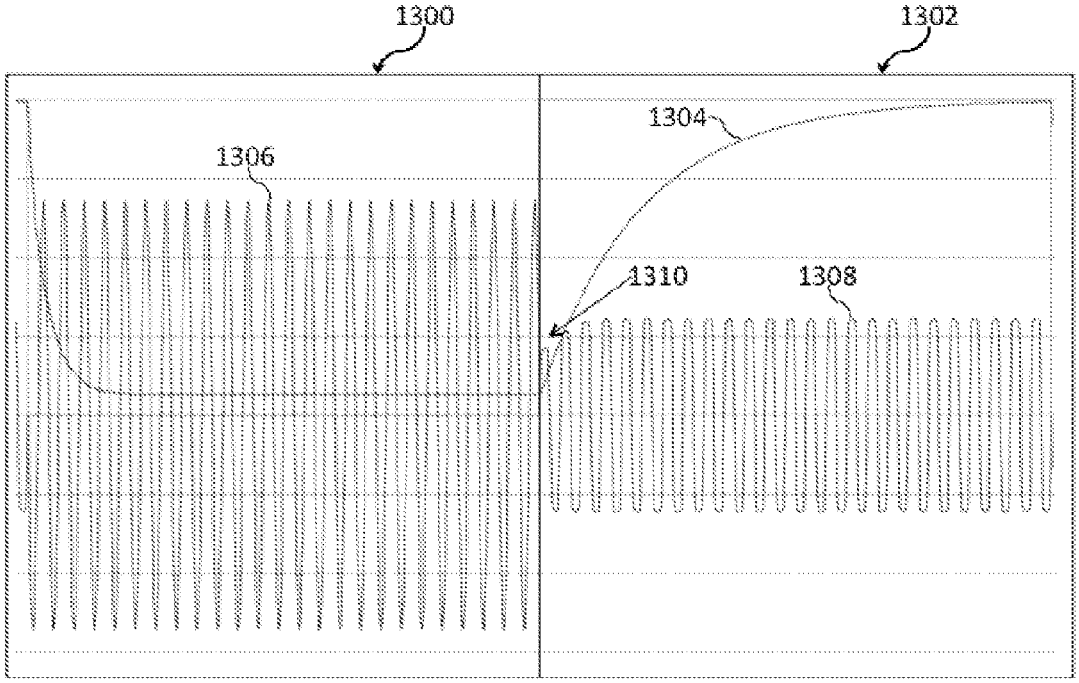
FIG. 13 depicts a demonstration that can result from automatic gain control.

FIG. 13 depicts an exemplar possible output utilizing automatic gain control. In some embodiments a switch state control signal 1304 can be used to regulate a supervised gain control unit during the transition from a bypass signal effects mode 1300 to an active signal effects mode 1302 the result being amplitude suppression of a signal 1310.

FIG. 13 depicts a demonstration that can result from automatic gain control. In some embodiments a signal processing device 100 can be configured to switch between a first state, characterizing a bypass signal effects mode 1300, and a second state, characterizing an active signal effects mode 1302. A switch state control signal 1304 can indicate the present state occupied by the signal processing unit 100.

As depicted signal 1306 can be an out of range signal comprising a voltage spike, or switching transient. A signal such as 1306 is passed unaltered when a signal processing unit 100 is operated in a bypass mode. In a bypass signal effects mode, a signal 1306 can be routed from the input interconnect 104 directly to the output interconnect 106, bypassing the signal effects unit 108.

Alternatively, a signal processing unit can be operated in an active signal effects mode. Operated in such a mode 1302, the automatic gain control can be activated with a result being an amplitude limited signal 1308.

FIG. 13 also demonstrates the results of automatic gain control. In some embodiments a switch state control signal 1304 can be used to regulate a supervised gain control unit during the transition from a bypass signal effects mode 1300 to an active signal effects mode 1302 the result being amplitude suppression of a signal 1310.

Figure 14:
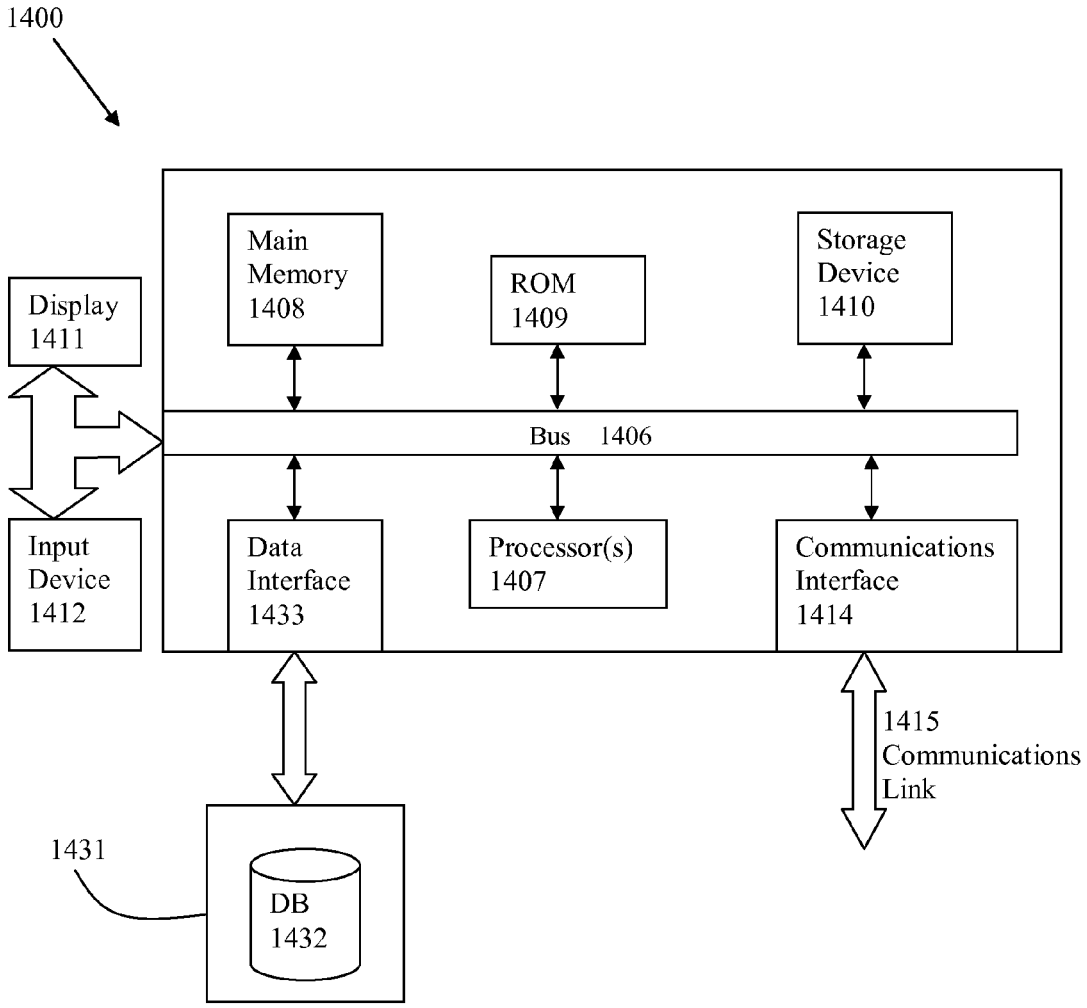
FIG. 14 depicts a computer system capable of executing instructions to practice the embodiments.

The execution of the sequences of instructions required to practice the embodiments may be performed by a computer system 1400 as shown in FIG. 14. In an embodiment, execution of the sequences of instructions is performed by a single computer system 1400. According to other embodiments, two or more computer systems 1400 coupled by a communication link 1415 may perform the sequence of instructions in coordination with one another. Although a description of only one computer system 1400 will be presented below, however, it should be understood that any number of computer systems 1400 may be employed to practice the embodiments.

A computer system 1400 according to an embodiment will now be described with reference to FIG. 14, which is a block diagram of the functional components of a computer system 1400. As used herein, the term computer system 1400 is broadly used to describe any computing device that can store and independently run one or more programs.

Each computer system 1400 may include a communication interface 1414 coupled to the bus 1406. The communication interface 1414 provides two-way communication between computer systems 1400. The communication interface 1414 of a respective computer system 1400 transmits and receives electrical, electromagnetic or optical signals, that include data streams representing various types of signal information, e.g., instructions, messages and data. A communication link 1415 links one computer system 1400 with another computer system 1400. For example, the communication link 1415 may be a LAN, in which case the communication interface 1414 may be a LAN card, or the communication link 1415 may be a PSTN, in which case the communication interface 1414 may be an integrated services digital network (ISDN) card or a modem, or the communication link 1415 may be the Internet, in which case the communication interface 1414 may be a dial-up, cable or wireless modem.

A computer system 1400 may transmit and receive messages, data, and instructions, including program, i.e., application, code, through its respective communication link 1415 and communication interface 1414. Received program code may be executed by the respective processor(s) 1407 as it is received, and/or stored in the storage device 1410, or other associated non-volatile media, for later execution.

In an embodiment, the computer system 1400 operates in conjunction with a data storage system 1431, e.g., a data storage system 1431 that contains a database 1432 that is readily accessible by the computer system 1400. The computer system 1400 communicates with the data storage system 1431 through a data interface 1433. A data interface 1433, which is coupled to the bus 1406, transmits and receives electrical, electromagnetic or optical signals, that include data streams representing various types of signal information, e.g., instructions, messages and data. In embodiments, the functions of the data interface 1433 may be performed by the communication interface 1414.

Computer system 1400 includes a bus 1406 or other communication mechanism for communicating instructions, messages and data, collectively, information, and one or more processors 1407 coupled with the bus 1406 for processing information. Computer system 1400 also includes a main memory 1408, such as a random access memory (RAM) or other dynamic storage device, coupled to the bus 1406 for storing dynamic data and instructions to be executed by the processor(s) 1407. The main memory 1408 also may be used for storing temporary data, i.e., variables, or other intermediate information during execution of instructions by the processor(s) 1407.

The computer system 1400 may further include a read only memory (ROM) 1409 or other static storage device coupled to the bus 1406 for storing static data and instructions for the processor(s) 1407. A storage device 1410, such as a magnetic disk or optical disk, may also be provided and coupled to the bus 1406 for storing data and instructions for the processor(s) 1407.

A computer system 1400 may be coupled via the bus 1406 to a display device 1411, such as, but not limited to, a cathode ray tube (CRT), for displaying information to a user. An input device 1412, e.g., alphanumeric and other keys, is coupled to the bus 1406 for communicating information and command selections to the processor(s) 1407.

According to one embodiment, an individual computer system 1400 performs specific operations by their respective processor(s) 1407 executing one or more sequences of one or more instructions contained in the main memory 1408. Such instructions may be read into the main memory 1408 from another computer-usable medium, such as the ROM 1409 or the storage device 1410. Execution of the sequences of instructions contained in the main memory 1408 causes the processor(s) 1407 to perform the processes described herein. In alternative embodiments, hard-wired circuitry may be used in place of or in combination with software instructions. Thus, embodiments are not limited to any specific combination of hardware circuitry and/or software.

The term "computer-usable medium," as used herein, refers to any medium that provides information or is usable by the processor(s) 1407. Such a medium may take many forms, including, but not limited to, non-volatile, volatile and transmission media. Non-volatile media, i.e., media that can retain information in the absence of power, includes the ROM 1409, CD ROM, magnetic tape, and magnetic discs. Volatile media, i.e., media that can not retain information in the absence of power, includes the main memory 1408. Transmission media includes coaxial cables, copper wire and fiber optics, including the wires that comprise the bus 1406. Transmission media can also take the form of carrier waves; i.e., electromagnetic waves that can be modulated, as in frequency, amplitude or phase, to transmit information signals. Additionally, transmission media can take the form of acoustic or light waves, such as those generated during radio wave and infrared data communications.

In the foregoing specification, the embodiments have been described with reference to specific elements thereof. It will, however, be evident that various modifications and changes may be made thereto without departing from the broader spirit and scope of the embodiments. For example, the reader is to understand that the specific ordering and combination of process actions shown in the process flow diagrams described herein is merely illustrative, and that using different or additional process actions, or a different combination or ordering of process actions can be used to enact the embodiments. The specification and drawings are, accordingly, to be regarded in an illustrative rather than restrictive sense.

It should also be noted that the present disclosure can be implemented in a variety of computer systems. The various techniques described herein may be implemented in hardware or software, or a combination of both. Preferably, the techniques are implemented in computer programs executing on programmable computers that each include a processor, a storage medium readable by the processor (including volatile and non-volatile memory and/or storage elements), at least one input device, and at least one output device. Program code is applied to data entered using the input device to perform the functions described above and to generate output information. The output information is applied to one or more output devices. Each program is preferably implemented in a high level procedural or object oriented programming language to communicate with a computer system. However, the programs can be implemented in assembly or machine language, if desired. In any case, the language may be a compiled or interpreted language. Each such computer program is preferably stored on a storage medium or device (e.g., ROM or magnetic disk) that is readable by a general or special purpose programmable computer for configuring and operating the computer when the storage medium or device is read by the computer to perform the procedures described above. The system may also be considered to be implemented as a computer-readable storage medium, configured with a computer program, where the storage medium so configured causes a computer to operate in a specific and predefined manner. Further, the storage elements of the exemplary computing applications may be relational or sequential (flat file) type computing databases that are capable of storing data in various combinations and configurations.

Although exemplary embodiments have been described in detail above, those skilled in the art will readily appreciate that many additional modifications are possible in the exemplary embodiments without materially departing from the novel teachings and advantages. Accordingly, these and all such modifications are intended to be included within the breadth and scope in accordance with the appended claims.

What is claimed is:

1. A bypass switching system comprising:

a switching unit adapted for routing signals;

a signal effects unit;

an output interconnect unit coupled with said switching unit via a first signal path;

an input interconnect unit coupled with said switching unit via a second signal path;

a switch state detection unit coupled with said switching unit; and a signal conditioning unit coupled with said switching unit via a third signal path and fourth signal path, with said switch state detection unit, and with said signal effects unit, wherein said bypass switching system is configured to transition between a first state and a second state by executing a sequenced set of events controlled in part from said switch state detection unit.

2. The system of claim 1 wherein said bypass switching system is further configured to transition from said second state to a third state.

3. The system of claim 1 further comprising:

a low impedance feedback unit coupled with said signal effects unit and with said switch state detection unit;

wherein said low impedance feedback unit is configured to control said switch state detection unit proportionally to a measurement of the output impedance of said signal effects unit.

4. The system of claim 1 wherein said sequence set of events comprises the steps of:

disconnecting said first signal path from said second signal path;

pausing for a first prescribed time delay;

disabling said signal conditioning unit;

pausing for a second prescribed time delay;

connecting said third signal path to said first signal path;

pausing for a third prescribed time delay; and connecting said fourth signal path to said second signal path.

5. The system of claim 1 wherein said sequence set of events comprises the steps of:

disconnecting a fourth signal path to said second signal path;

pausing for a first prescribed time delay;

disconnecting said third signal path to said first signal path;

pausing for a second prescribed time delay;

enabling signal conditioning unit;

pausing for a third prescribed time delay; and connecting said first signal path to said second signal path.

6. The system of claim 1 wherein said signal conditioning unit comprises an automatic attenuation device configured to attenuate signals proportional to said signals' initial amplitude.

7. The system of claim 1 wherein said signal conditioning unit comprises a supervised gain control configured to suppress signals under control from said switch state detection unit.

8. The system of claim 1 wherein said switching unit comprises an asymmetric double pole double throw switch.

9. The system of claim 1 wherein said switch state detection unit comprises an RC network configured to measure said switching unit's present state and communicate the measured state to said signal conditioning unit.

10. The system of claim 6 wherein said automatic attenuation device comprises solid state circuits containing diodes.

11. The system of claim 7 wherein said supervised gain control comprises solid state circuits containing field effect transistors (FETs).

* * * * *